US005145393A

United States Patent [19]

Schoon

[11] Patent Number: 5,145,393

[45] Date of Patent: Sep. 8, 1992

[54] ELECTRICAL PLUG DEVICE

[76] Inventor: Leslie R. Schoon, Box 66, Rockton, Ill. 61072

[21] Appl. No.: 770,230

[22] Filed: Oct. 2, 1991

Related U.S. Application Data

[63] Continuation-in-part of Ser. No. 609,710, Nov. 6, 1990, abandoned.

[51] Int. Cl.[5] ..... H01R 11/22

[52] U.S. Cl. ..... 439/269; 439/148

[58] Field of Search ..... 439/148, 269, 269.1, 439/650, 651, 655

[56] References Cited

U.S. PATENT DOCUMENTS

| | | | |
|---|---|---|---|
| 1,119,864 | 12/1914 | Ovington et al. | 439/269 |
| 1,957,773 | 5/1934 | Good | 439/269 |
| 1,957,778 | 5/1934 | Hopkins, Jr. | 439/269.1 |
| 2,222,715 | 11/1940 | Kuhlman | 439/269.1 |
| 2,254,754 | 4/1941 | Reece | 439/269 |
| 2,292,554 | 8/1942 | Herber | 439/269 |
| 2,390,852 | 12/1945 | Stee | 439/269.1 |
| 2,407,894 | 9/1946 | Miller | 439/148 |
| 2,493,457 | 1/1950 | Kenure et al. | 439/269.1 |
| 2,629,761 | 2/1953 | Determan | 439/148 |
| 2,775,744 | 4/1956 | Heunenan | 439/269 |
| 2,850,711 | 9/1958 | Terlinde | 439/269.1 |
| 2,932,811 | 4/1960 | Abraham et al. | 439/148 |
| 3,686,616 | 8/1972 | Bowerman | 439/148 |
| 3,971,619 | 7/1976 | Rohrssen | 339/189 |
| 4,206,957 | 6/1980 | Ludnig et al. | 339/40 |
| 4,479,688 | 10/1984 | Jennings | 339/37 |
| 4,508,933 | 4/1985 | Carvel | 174/67 |
| 4,867,697 | 9/1989 | Borges | 439/265 |
| 5,009,610 | 4/1991 | Woskow | 439/148 X |

FOREIGN PATENT DOCUMENTS

| | | | |
|---|---|---|---|
| 2607974 | 6/1988 | France . | |
| 743323 | 7/1975 | South Africa . | |
| 935829 | 9/1963 | United Kingdom | 439/148 |

*Primary Examiner*—Larry I. Schwartz
*Assistant Examiner*—J. R. Daulton
*Attorney, Agent, or Firm*—David J. Archer

[57] ABSTRACT

An electrical plug device is disclosed for establishing an electrical connection when the device is inserted within an electrical outlet socket. The device includes a housing and a first blade which extends from the housing for establishing a first electrical connection with the outlet socket. A second blade is electrically insulated from the first blade with the second blade extending from the housing for establishing a second electrical connection with the outlet socket. A biasing device co-operates with at least one of the blades for biasing the first and second blades relative to each other such that the blades establish an interference fit within the outlet socket so that inadvertent removal of the blades from within the outlet socket is inhibited. A manual release is connected to at least one of the blades for selectively counteracting the biasing device such that when the release is in a first disposition thereof, the blades are locked within the outlet socket and when the release is in a second disposition thereof the blades are released from engagement with the outlet socket so that removal of the plug device from the outlet socket is permitted.

5 Claims, 4 Drawing Sheets

ELECTRICAL PLUG DEVICE

CROSS REFERENCE TO RELATED APPLICATION

The present application is a continuation-in-part of copending application Ser. No. 07/609710, abandoned filed Nov. 6th 1990. All of the subject matter of Ser. No. 07/609710 is incorporated herein by reference.

FIELD OF THE INVENTION

The present invention relates to an electrical plug device for establishing an electrical connection when the device is inserted within an electrical outlet socket. More particularly, the present invention relates to an electrical plug device which inhibits the inadvertent removal of the plug device from an outlet socket.

BACKGROUND AND OBJECTS OF THE INVENTION

Many indoor electrical appliances such as vacuum cleaners include an electrical cord having a plug thereon for insertion within an electrical outlet socket. During use of such an appliance it has been found that when the user thereof has reached the extent of the cord there exists a tendency to pull the plug out of the outlet socket thereby cutting of the electrical supply to the appliance.

Similarly, when operating outside appliances such as trimmers, electric lawn mowers, strimmers or the like, there exists the same problem that when the appliance is moved away from the outlet socket, it is easy to pull the electrical plug from engagement within the electrical outlet socket.

Although attempts have been made to tie such an electrical cord around a pipe disposed adjacent to the outlet, such is not always possible, and it is often necessary for the operator to return to the electrical outlet socket to re-establish electrical contact between the plug and the outlet socket.

Although it would be possible to provide an outlet socket with a locking means for locking the plug against removal, the provision of such a device within each outlet socket would be relatively costly.

The present invention provides a simple electrical plug device having a release mechanism whereby the plug can be inserted and locked within an outlet socket and then released from engagement with the outlet socket when the plug is to be removed therefrom.

In another application of the present inventive concept, a safety plug is provided which prevents children or inmates of a mental institution or the like from gaining access to an electrical outlet source.

Therefore, it is the primary object of the present invention to provide an electrical plug device which overcomes the aforementioned inadequacies of the prior art devices and which makes a considerable contribution to the art of electrical plug devices for insertion within corresponding outlet sockets.

Another objects of the present invention is the provision of an electrical plug device having a first and a second blade for insertion within an outlet socket, the blades being biased relative to each other such that the blades establish an interference fit within the outlet socket so that inadvertent removal of blades from within the outlet socket is inhibited.

Another object of the present invention is the provision of an electrical plug device having a manual release which is connected to at least one of the blades for selectively counteracting the biasing means such that when the releasing means is in a first disposition, the blades are locked within the outlet socket and when the release means is in a second disposition, the blades are released from engagement within the outlet socket so that the removal of the plug from the outlet socket is permitted.

Another object of the present invention is the provision of a plug device in which the biasing means is of resilient material for urging the blades away from each other.

A further objective of the present invention is the provision of offset portions for increasing the interference fit of the blades within the outlet socket.

Another object of the present invention is the provison of a safety plug for preventing unauthorized access to an outlet supply.

Other objects and advantages of the present invention will be readily apparent to those skilled in the art by a consideration of the detailed description contained hereinafter, taken in conjunction with the annexed drawings.

SUMMARY OF THE INVENTION

The present invention relates to an electrical plug device for establishing an electrical connection when the device is inserted within an electrical outlet socket. The device includes a housing and a first blade means which extends from the housing for establishing a first electrical connection with the outlet socket.

A second blades means is electrically insulated from the first blades means with the second blade means extending from the housing for establishing a second electrical connection with the outlet socket.

Biasing means co-operate with at least one of the blades means for biasing the first and the second blade means relative to each other such that the blade means establish an interference fit within the outlet socket so that inadvertent removal of the blade means from within the outlet socket is inhibited.

A manual release means is connected to at least one of the blade means for selectively counteracting the biasing means such that when the release means is in a first disposition thereof, the blade means is locked within the outlet socket and when the release means is in a second disposition thereof, the blade means are released from engagement from within the outlet socket so that removal of the plug device from the outlet socket is permitted.

In a more specific embodiment of the present invention, the plug device includes a holder for holding the first and second blade means. The holder defines a U-shaped channel having a first and second portion for the reception therein of the first and second blade means respectively.

The first and second portions each have a first and a second end. The first end of the first portion extends through the holder such that the first blade means extends through and protrudes from the first end of the first portion. The first end of the second portion extends through the holder such that the second blade means extends through and protrudes from the first end of the second portion.

More specifically, the second ends of the portions are disposed adjacent to each other and the holder further includes a partition for partitioning the first and the second portions from each other. The partition defines a first and a second step which are disposed respectively within the first and second portions. The first and the second steps permit the biasing of the blade means relative to each other.

The plug device also includes securing means extending through a cover and threadably engaging a bore defined by the partition such that the cover is removable secured to the holder.

Each of the blade means has a first and a second end, with the blade means each being of springy, electrically conductive material. The first ends of the blade means are diposed outside of the housing.

The second ends of the blade means are disposed within the second ends of the first and second portions respectively.

The first ends of the blade means are serrated such that frictional engagement between the first ends of the blade means and the outlet socket is increased when the release means is in the first disposition thereof.

The blade means further include a first and a second terminal means electrically connected to the second ends respectively of the first and second blade means such that electrical connection of the blade means is permitted.

The holder defines an aperture adjacent to the terminals such that the electrical connection to the terminal means extends through the aperture.

The biasing means more specifically includes at least one compression spring which is disposed between the first and second blade means for urging the blade means into a first locking disposition thereof.

More specifically, the biasing means includes a first and a second compression spring. The first and second springs are disposed respectively within the first and second portions and adjacent to the first ends respectively of the portions. The first spring is disposed between the partition and the first blade means. The second spring is disposed between the partition and the second blade means such that the springs urge the blade means away from each other to lock the plug device within the outlet socket.

The partition defines a first and a second recess for the reception therein of the first and second springs respectively.

The housing defines a first and second bore, the bores being disposed adjacent to the first and second blade means respectively. The bores slidably receive therein the manual release means.

More specifically, the release means includes a first and a second button slidably disposed within the first and second bore respectively of the housing. The buttons each have a blade engaging end and a finger engaging end. The blade engaging ends of the buttons are disposed on the opposite side of the respective blade means relative to the biasing means such that when the release means is disposed in the second disposition thereof, the blade means are urged by the buttons towards each other against the biasing means such that the first and second blade means are released from the outlet socket.

The blade engaging ends of the buttons also include a first and a second head respectively for limiting the outward travel of the buttons within the first and second bores.

A further embodiment of the present invention includes a biasing means in which a resilient polymeric insulating material is disposed between the blade means for urging the blade means away from each other to establish the aforementioned interference fit.

In yet another embodiment of the present invention, the first blade means includes a first blade having a first and a second extremity. A first offset portion is disposed spaced and parallel relative to the first blade. A first transitional portion extends from the first extremity of the first blade to the first offset portion. Also, a second blade means includes a second blade having a first and a second termination. A second offset portion is disposed spaced and parallel relative to the second blade. A second transitional portion extends from the first termination of the second blade to the second offset portion such that in use of the device, the first and second offset portions releasably engage the outlet socket when the release means is in the first disposition thereof.

In another embodiment of the present invention, a safety plug device is inserted within an electrical socket so that unauthorized access to the outlet socket is inhibited. The safety plug device includes a housing and a first and second blade means. Each blade means has a first and a second end. The first ends of the blade means extend from the housing. The blade means are of electrically insulating material such that insertion of the blade means within the outlet socket is permitted.

Biasing means bias the blade means relative to each other such that the blade means establish an interference fit within the outlet socket so that unauthorized removal of blade means from within the outlet socket is inhibited.

Manual release means are connected to at least one of the blade means for selectively counteracting the biasing means such that when the release means is in a first disposition thereof, the blade means are locked within the outlet socket and when the release means is in a second disposition thereof, the blade means are released from engagement within the outlet socket so that removal of the plug device is permitted.

In yet another embodiment of the present invention, a safety plug device has first and second blade means which include a plurality of first and second blades. Each of the first blades is disposed spaced and parallel relative to each other. Also, each of the second blades is disposed spaced and parallel relative to each other such that the plurality of first and second blades cooperate with an outlet socket defining multiple outlets.

Many modifications and variations of the present invention will be readily apparent to those skilled in the art by a consideration of the detailed description contained hereinafter taken in conjunction with the annexed drawings. However, such modifications and variations fall within the spirit and scope of the present invention as defined by the appended claims.

BRIEF DESCRIPTION OF THE DRAWINGS

Similar reference characters refer to similar parts throughout the various views of the drawing.

DETAILED DESCRIPTION OF THE DRAWINGS

Figure 1:
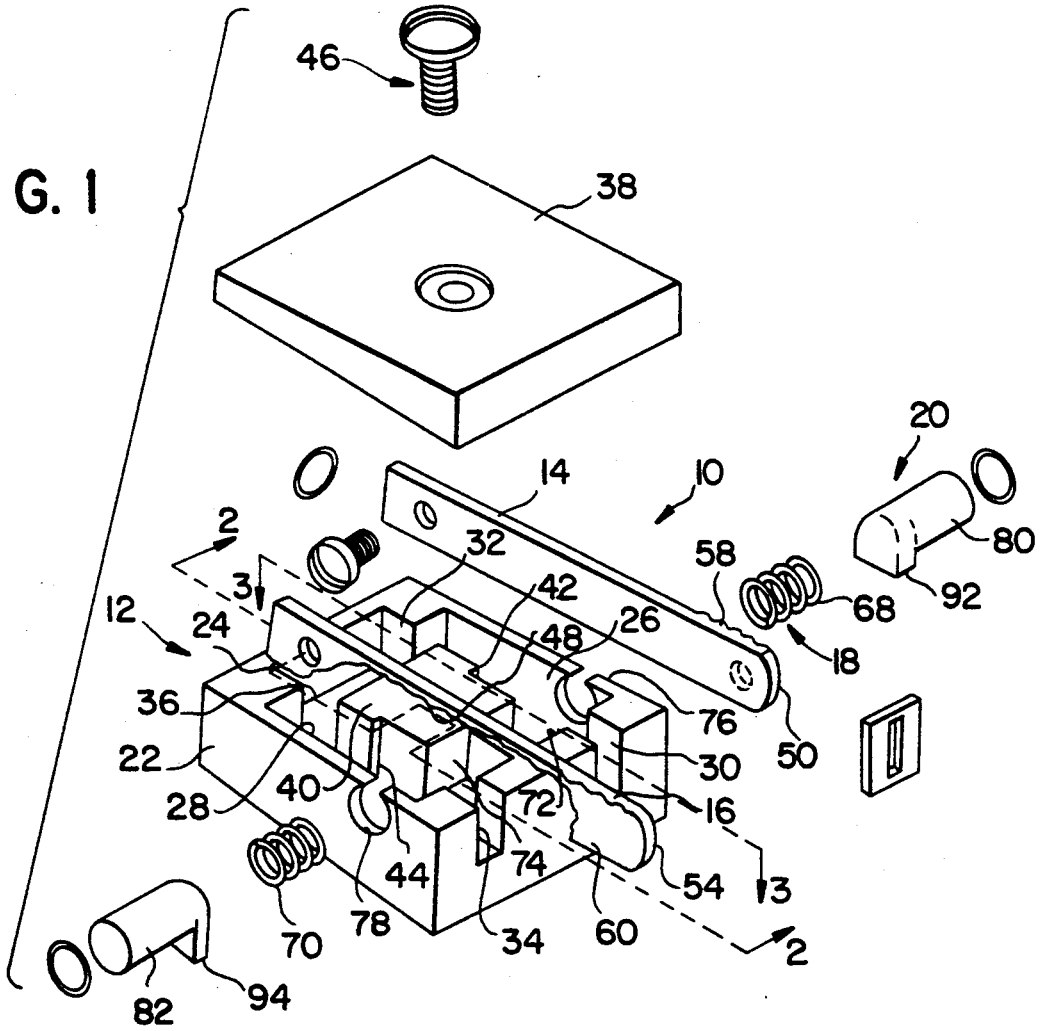
FIG. 1 is an exploded perspective view of an electrical plug device according to the present invention.

FIG. 1. is an exploded perspective view of an electrical plug device generally designated 10. according to the present invention for establishing an electrical connection when the device 10. is inserted with an electrical outlet socket (not shown). a first blade means 14. which extends from the housing 12. for establishing a first electrical connection with the outlet socket.

Figure 2:
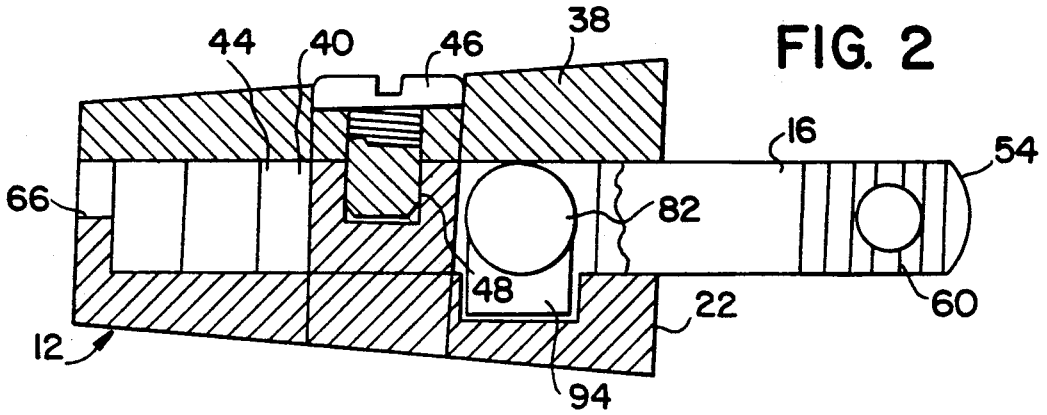
FIG. 2 is a sectional view taken on the line 2—2 of FIG. 1. but showing the closure secured to the holder.

FIG. 2. is a sectional view taken on the line 2—2 of FIG. 1. and shows the housing 12 and a blade means extending therefrom.

Figure 3:
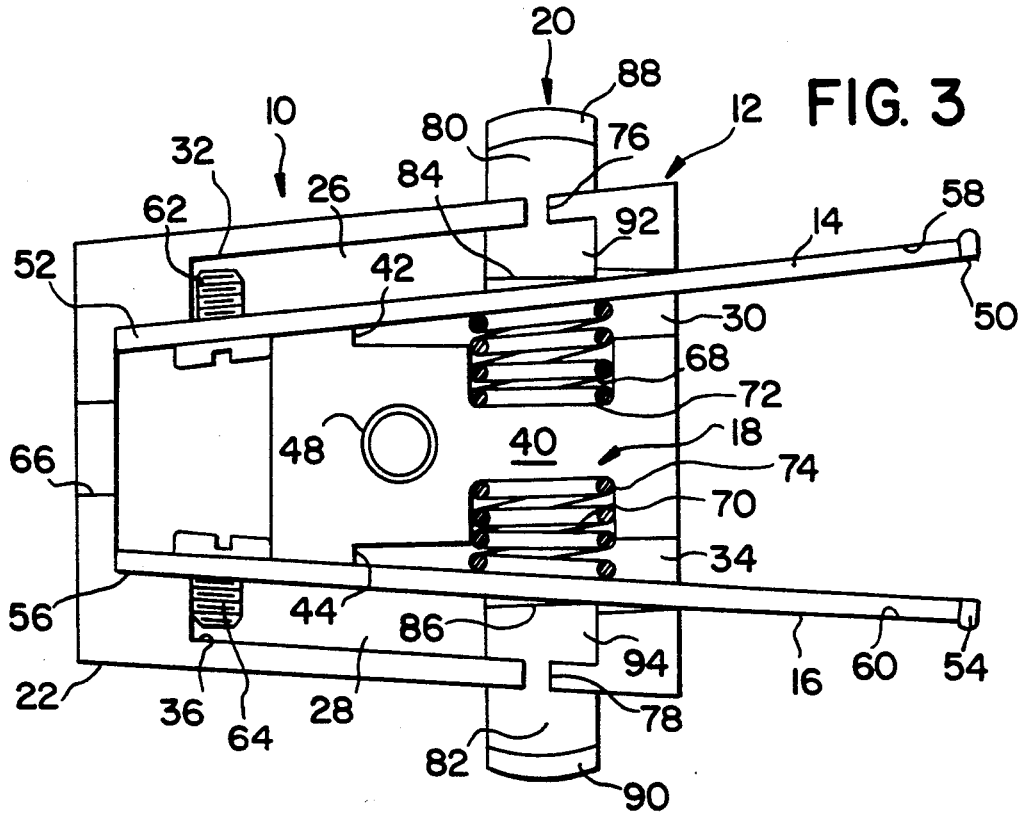
FIG. 3 is a sectional view taken on the line 3—3 of FIG. 1.; showing the blades in the locked first disposition within the socket.

FIG. 3 is a sectional view taken on the line 3—3 of FIG. 1 and shows the first blade means 14 which extends from the housing 12 for establishing a first electrical connection with the outlet socket.

A second blade means 16 is electrically insulated from the first blade means 14. The second blade means 16 extends from the housing 12 for establishing a second electrical connection with the outlet socket.

Biasing means generally designated 18 co-operates with at least one of the blades 14, 16, for biasing the blade 14, 16, relative to each other such that the blade means 14, 16, establish an interference fit within the outlet socket. The arrangement is such that inadvertent removal of the blades 14, 16, from within the outlet socket is inhibited.

Figure 4:
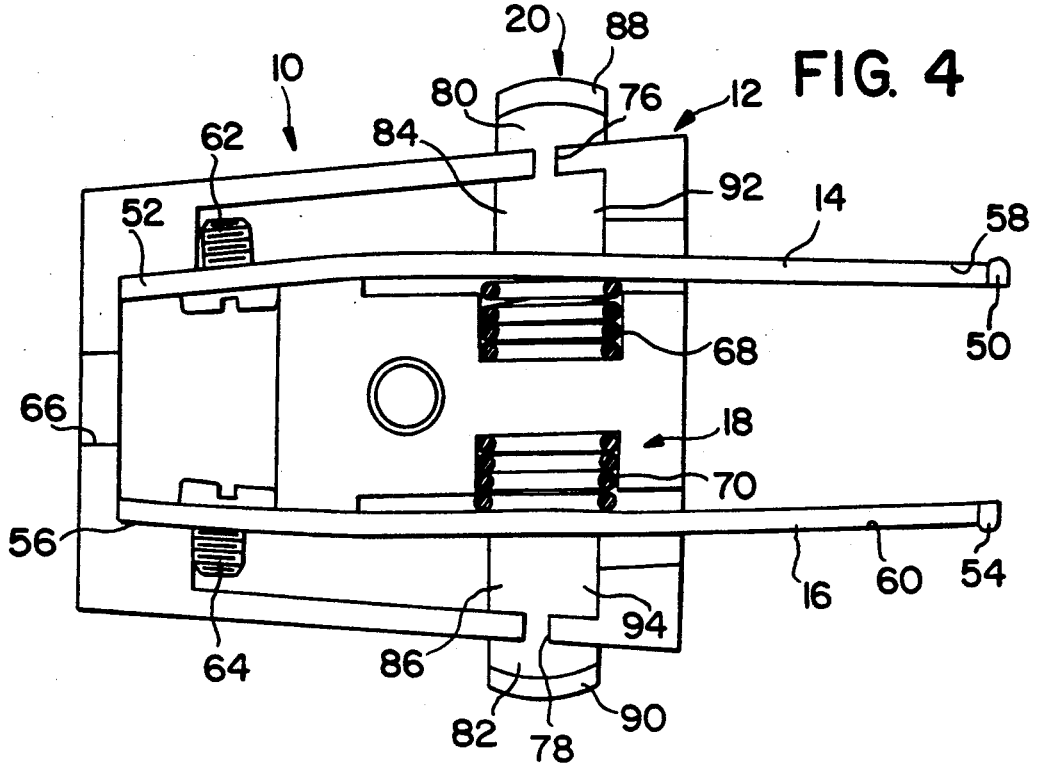
FIG. 4 is a similar view to that shown in FIG. 3 but shows the blades in a second disposition thereof to release the plug from the outlet socket.

Manual release means generally designated 20 are connected to at least one of the blade means 14, 16, for selectively counteracting the biasing means 18. The arrangement is such that when the release means 20 is in a first disposition thereof as shown in FIG. 3, the blade means 14, 16, are locked within the outlet socket and when the release means 20 is in a second disposition thereof as shown in FIG. 4, the blade means 14, 16, are released from engagement from within the outlet socket so that removal of the plug device 10 from the outlet socket is permitted.

More specifically, as shown in FIG. 1, the housing 12 includes a holder 22 for holding the first and second blade means 14, 16. The holder 22 defines a U-shaped channel 24. The U-shaped channel 24 has a first and a second portion 26 and 28 respectively for the reception therein of the first and second blade means 14 and 16 respectively.

The first and second portions 26 and 28 have a first and a second end. The arrangement is such that the first portion 26 has a first and a second end 30 and 32 respectively. Similarly, the second portion 28 has a first and a second end 34 and 36 respectively as shown in FIG. 3.

The arrangement is such that the first end 30 of the first portion 26 extends through the holder 22 such that the first blade 14 extends through and protrudes from the first end 30 of the first portion 26.

Similarly, the first end 34 of the second portion 28 extends through the holder 22 such that the second blade means 10 extends through and protrudes from the first end 34 of the second portion 28.

A cover 38 covers the channel 24 as shown in FIGS. 1 and 2.

The second ends 32 and 36 of the first and second portion 26 and 28 are adjacent to each other.

The holder 22 also includes a partition 40 such that the first and second portion 26 and 28 are partitioned from each other. The partition 40 defines a first and a second step 42 and 44 respectively. The steps 42 and 44 are disposed respectively within the first and second portions 26 and 28. The first and the second steps 42 and 44 permit the biasing of the blade means 14 and 16 relative to each other.

The plug device 10 also includes a securing means generally designated 46 such as a screw extending through the cover 38 and threadably engaging a bore 48 defined by the partition 40 as shown in FIGS. 1 to 4. The arrangement is such that the cover 38 is removabley secured to the holder 22.

As shown in FIGS. 3 and 4, each of the blade means 14 and 16 has a first and a second end. More specifically, the blade means 14 has a first and a second end 50 and 52 respectively. Similarly, the blade means 16 has a first and a second end 54 and 56 respectively. The blade means 14 and 16 are each of a springy electrically conductive material with the first ends 50 and 54 respectively of the blade means 14 and 16 being disposed outside the housing 12.

The second ends of the blade means 14 and 16 that is the ends 52 and 56 are disposed within the second ends 32, 36 of the first and second portions 26 and 28 respectively. As shown in FIG. 1, the first ends 50 and 54 of the blade means 14 and 16 are serrated at 58 and 60 such that frictional engagement between the first ends 50 and 54 respectively of the blade means 14 and 16 and the outlet socket is increased when the release means 20 is in the first disposition thereof.

As shown in FIGS. 3 and 4 the blade means 14 and 16 also include a first and second terminal means 62 and 64 electrically connected to the second ends 52 and 56 respectively of the first and second blade means 14 and 16 such that connection of the blade means 14 and 16 to an electrical circuit is permitted.

The holder 22 defines an aperture 66 disposed adjacent to the terminals 62 and 64 such that the electrical connection to the terminal means 62, 64 extends through the apperture 66.

As shown in FIGS. 3 and 4, the biasing means 18 includes more specifically a compression spring 68 disposed between the first and second blade means 14 and 16 for urging the blade means into the first locking disposition thereof.

More specifically as shown in FIG. 3 and 4, the biasing means 18 includes a first and a second compression spring 68 and 70. The first and second springs 68 and 70 are disposed respectively within the first and second portions 26 and 28 and adjacent to the first ends 30 and 34 respectively of the portions 26 and 28.

The first spring 68 is disposed between the partition 40 and the first blade means 14. The second spring 70 is disposed between the partition 40 and second blade means 16 such that the springs 68, 70 urge the blade means 14 and 16 away from each other to lock the plug device 10 within the outlet.

The partition 40 defines a first and a second recess 72 and 74 respectively as shown in FIG 1. The recesses 72 and 74 are for the reception therein of the first and second springs 68 and 70.

The housing 12 defines a first and a second bore 76 and 78. The bores 76 and 78 are disposed adjacent to the first and second blade means 14 and 16. The bores 76 and 78 slidably receive therein the manual release means generally designated 20.

More specifically, the release means 20 includes a first and a second button 80 and 82 which are slidably disposed within the first and the second bores 76 and 78 respectively of the housing 12. The buttons 80 and 82 each have a blade engaging end 84 and 86 respectively and a finger engaging end 88 and 90 respectively. The blade engaging ends 84 and 86 are disposed on the opposite sides of the respective blade 14 and 16 respectively relative to the biasing means 68 and 70 such that when the release means 20 is disposed in the second disposition thereof as shown in FIG. 4, the blade means 14 and 16 are urged by the buttons 80 and 82 towards each other against the biasing means 68 and 70 such that the first and second blade means 14 and 16 are released from the outlet.

The blade engaging ends that is the ends 84 and 86 includes a first and a second head 92 and 94 as shown in FIGS. 1 and 2 for limiting the outward travel of the buttons 80 and 82 within the first and second bores 76 and 78.

In operation of the plug device according to the present invention, the plug is inserted into the outlet socket with the buttons 80 and 82 depressed. When the plug has been fully inserted and electrical contact has been achieved, the buttons are released so that the blade means 14 and 16 are biased outwardly into locking engagement with the socket. When the plug is to be disconnected, the buttons are again depressed thereby releasing the plug from the outlet.

The blade means are flexible ribbed offset blades provided with internal springs thus giving the unit holding and gripping ability which is completely controlled by the external button means. The housing is of insulating plastics material. The plug would be available as a replacement for conventional plug. Also, as shown in the drawings, the plug is provided with O-ring seals and other seals for rendering the plug watertight.

Additionally, it will be understood that although a non polarized plug has been described with reference to the drawings, the invention is equally applicable to polarized and three pin grounded plugs.

Also the present invention avoids the dangers associated with young children trying to insert and remove electrical plugs from the socket because with the plug device according to the present invention, a child is unable to simultaneously depress both buttons and insert or remove the plug from the socket.

The present invention avoids the need for costly replacement of all the outlet sockets and merely necessitates replacement of appliance plugs.

The present invention provides a simple and inexpensive plug device which enables the plug to be locked within an outlet socket so that the plug can be selectively locked within the socket or released thereform. Also, the plug device according to the present invention is able to be totally rebuilt in the event that any of the parts thereof wear out so that such worn out parts can be replaced.

Figure 5:
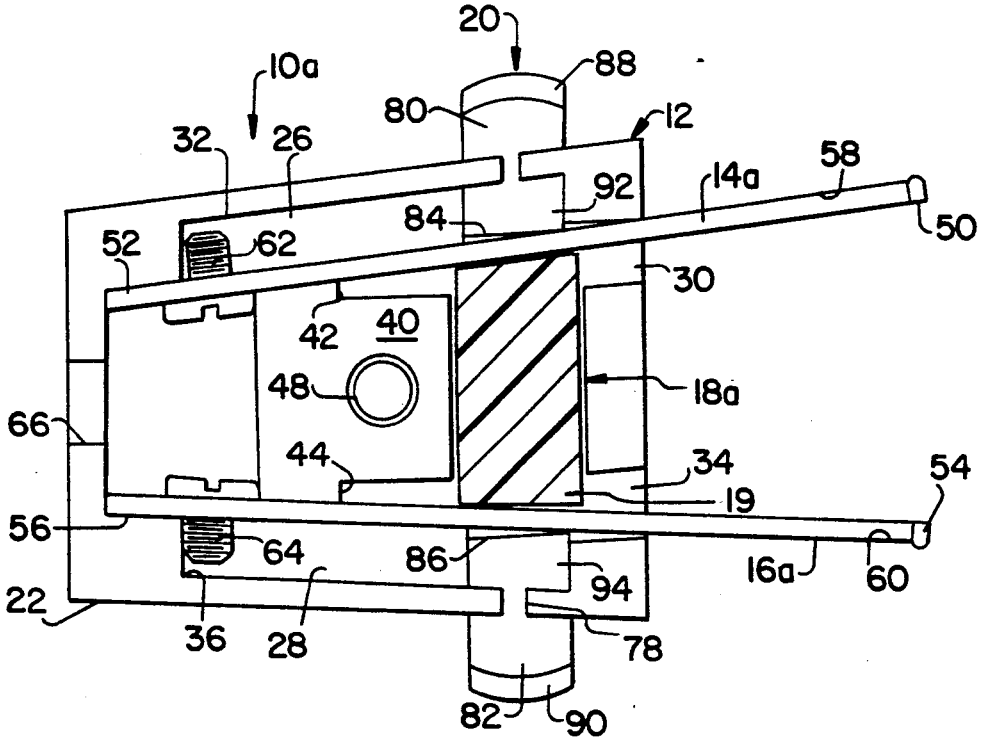
FIG. 5 is a sectional view of a further embodiment of the present invention showing the biasing means of resilient material.

FIG. 5 is a sectional view of a further embodiment of the present invention. FIG. 5 shows an electrical plug 10*a* which includes a biasing means 18*a* in which a resilient polymeric insulating material 19 is disposed between the blade means 14*a*,16*a* urging the blade meansa 14*a*,16*a* away from each other to establish the aforementioned interference fit.

Figure 6:
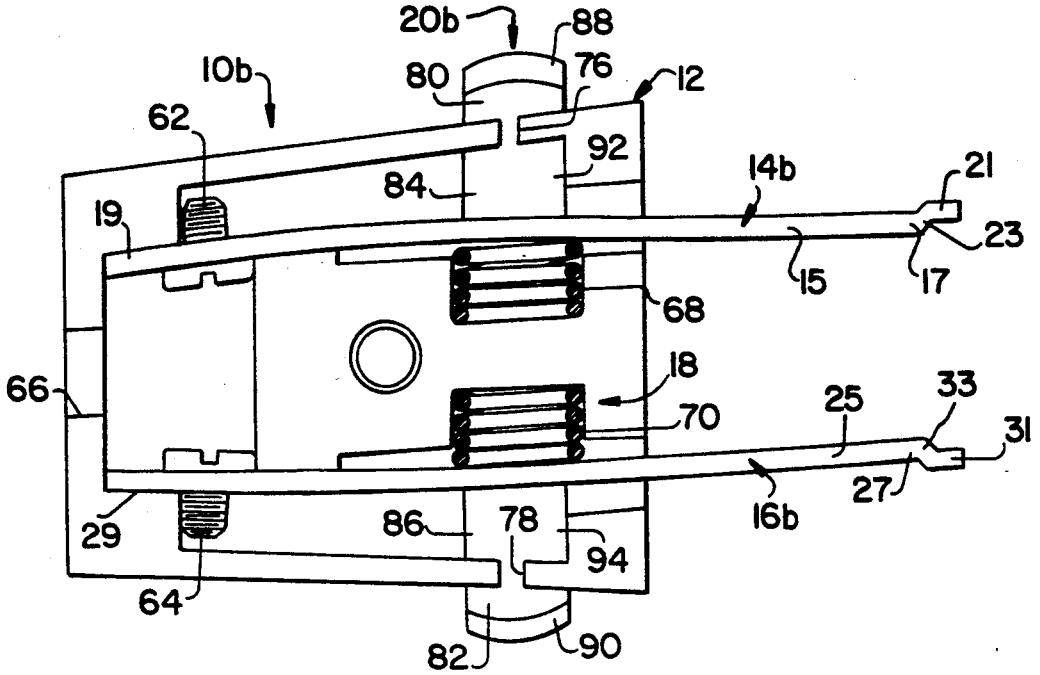
FIG. 6 is a sectional view of a further embodiment of the present invention including offset portions.

In yet another embodiment of the present invention, as shown in FIG. 6, an electrical plug device 10*b* includes a first blade means 14*b* which includes a first blade 15 having a first and a second extremity 17 and 19 respectively. A first offset portion 21 is disposed spaced and parallel relative to the first blade 15. A first transitional portion 23 extends from the first extremity 17 of the first blade 15 to the first offset portion 21. Also, a second blade means 16*b* includes a second blade 25 having a first and a second termination 27 and 29 respectively. A second offset portion 31 is disposed spaced and parallel relative to the second blade 25. A second transitional portion 33 extends from the first termination 27 of the second blade 25 to the second offset portion 31 such that in use of the device, the first and second offset portions 21 and 31 respectively releasably engage the outlet socket when the release means 20*b* is the first disposition thereof.

Figure 7:
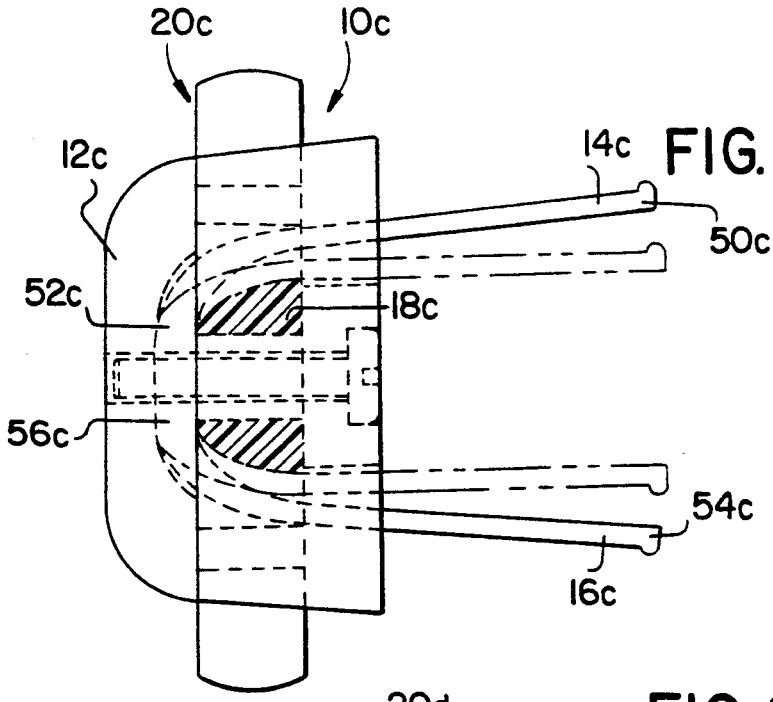
FIG. 7 is a sectional view of yet another embodiment of the present invention showing a safety plug device.

In another embodiment of the present invention as shown in FIG. 7 which is a sectional view, a safety plug device 10*c* is inserted within an electrical socket so that unauthorized access to the outlet socket is inhibited. The safety plug device 10*c* includes a housing 12*c* and a first and second blade means 14*c* and 16*c* respectively. Each blade means 14*c* and 16*c* has a first and a second end 50*a*52*c* and 54*c*,56*c* respectively. The first ends of the blade means extend from the housing. The blade means 14*c*,16*c* are of electrically insulating material such that insertion of the blade means 14*c*,16*c* within the outlet socket is permitted.

Biasing means 18*c* bias the blade means 14*c*,16*c* relative to each other from the disposition shown in phantom outline such that the blade means 14*c*,16*c* establish an interference fit within the outlet socket so that unauthorized removal of the blade means from within the outlet socket is inhibited.

Manual release means 20*c* are connected to at least one of the blade means for selectively counteracting the biasing means 18*c* such that when the release means 20*c* is in a first disposition thereof thhe blade means 14*c*,16*c* are locked within the outlet socket and when the release means 20*c* is in a second disposition thereof, as shown in phantom outline the blade means 14*c*,16*c* are released from engagement within the outlet socket so that removal of the plug device is permitted.

Figure 8:
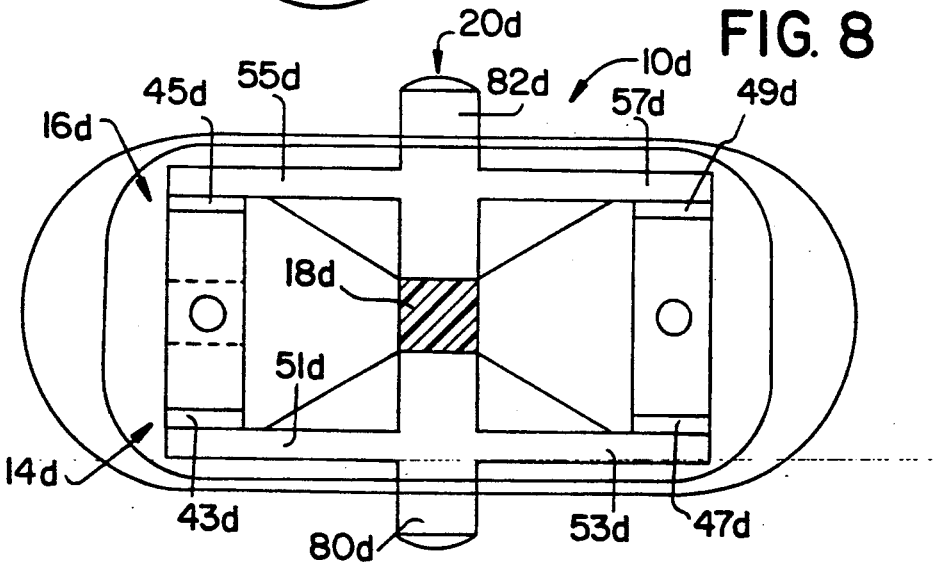
FIG. 8 is a sectional view similar to FIG. 7 but showing a variation of the safety plug in which a plurality of blades engage multiple outlets.

FIG. 8 is a sectional view of a safety plug device 10*d* according to another of the present invention. The plug 10*d* has first and second blade means 14*d*,16*d*which includes a plurality of first and second blades 43*d*,45*d*,47*d*,49*d*. Each of the first blade 43*d*,47*d* is disposed spaced and parallel relative to each other. Also, each of the second blades 45*d*,49*d* is disposed spaced and parallel relative to each other such that the plurality of first and second blades cooperate with an outlet socket defining multiple outlets.

The release means 20*d* includes buttons 80*d* and 82*d* with biasing means such as a block of resilient material 18*d* disposed therebetween. The blades 43*d*,45*d*,47*d*,49*d* are of flexible insulating material such that the blade 43*d* and 45*d* are resiliently inclined away fromn each other. Also, the blades 47*d*,49*d* are resiliently inclined away from each other. The bottom 80*d* includes a pair of ears 51*d* and 53*d* which bear against the blades 43*d*,47*d*. Also, the button 82*d* includes a further pair of ears 55*d*,57*d*, which bear against the blades 45*d*,49*d*. The arrangement is such that when the buttons 80*d*,82*d* are urged towards each other, the ears 51*d*,57*d* and 55*d*,57*d* press against the respective blades to move the blades from the locking disposition thereof as shown in FIG. 8 to a disposition in which the blades are released from the outlet socket.

Figure 9:
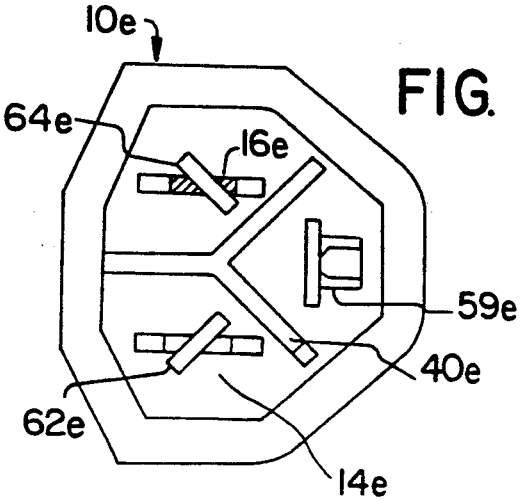
FIG. 9 is a sectional view of another embodiment of the present invention.

FIG. 9 is a sectional view of a further embodiment of the present invention and shows a plug device 10*e* having a grounding pin 59*e*. The plug device 10*e* includes an insulating partition 40*e* of y-shaped configuration disposed between a first and second blade means 14*e* and 16*e* respectively and the grounding pin 59*e* for electrically isolating the blade means and pin 14*e*,16*e*,59*e* relative to each other. The blade means 14*e*,16*e* each have terminal means 62*e*,64*e* respectively which are twisted relative to the blade means 14*e*,16*e* so that the terminals are disposed respectively in planes that intersect closely adjacent to the grounding pin 59*e* for facilitating connection of the terminal means to an electrical circuit.

The present invention primarily provides a unique plug which resists removal thereof from an outlet socket unit such plug is positively released by means of a manual release mechanism.

Additionally, the present invention provides a safety plug which prevents unauthorized access to an electrical outlet supply.

What is claimed is:

1. An electrical plug device for establishing an electrical connection when the device is inserted within an electrical outlet socket, said device comprising:

a housing;

first blade means extending from said for establishing a first electrical connection with the outlet socket;

a second blade means electrically insulated from said first blade means, said second blade means extending from said housing for establishing a second electrical connection with the outlet socket;

biasing means cooperating with at least one of said blades for biasing said first and second blade means relative to each other such that said blade means establish an interference fit within the outlet socket so that inadvertent removal of said blade means from with the outlet socket is inhibited;

manual release means connected to at least one of said blade means for selectively counteracting said biasing means such that when said release means is in a first disposition thereof, said blade means are locked within the outlet socket and when said release means is in a second disposition thereof, said blade means are released from engagement within the outlet socket so that removal of the plug device from the outlet socket is permitted;

said housing including:

a holder for holding said first and second blade means, said holder defining a U-shaped channel;

said U-shaped channel having a first and a second portion for the reeption therein of said first and second blade means respectively;

said first and said second portions eacch having a first and a second end, said first end of said first portion extending through said holder such that said first blade means extends through and protrudes from said first end of said first portion, said first end of said second portion extending through said holder such that said blade means extends through and protrudes from said first end of said second portion;

cover for covering said channel;

said second ends of said portions being adjacent to each other;

said holder further including:

a partition for partitioning said first and second portions from each other, said partition defining a first and second step disposed respectively within said first and second portions, said first step being disposed between said second end of said first portion and said first recess, said second step being disposed between said second end of said second portion and said second recess, said steps being formed integrally with said partition such that said steps slidably cooperate with said blade means for permitting said biasing of said blade means relative to each other;

said electrical plug device further including:

securing means extending through said cover and threadably engaging a bore defined by said partition such that said cover is removably secured to said holder;

said first and second blade means are each of springy, electrically conductive material, said blade means each having a first and a second end, said first ends of said blade means being disposed outside said housing, said second ends of said blade means being disposed within said second ends of said first and second portions respectively;

said first ends of said blade means being offset such that frictional engagement between said first ends of said blade means and the outlet socket is increased when said release means is in said first disposition thereof;

said biasing means including:

a first and a second comperssion spring, said first and second springs being disposed respectively within said first and second portions and adjacent to said first ends respectively of said portions, said first spring being disposed between said partition and said first blade means, said second spring being disposed between said partition and said second blade means such that said springs urge said blade means away from each other to lock the plug device within the outlet socket;

said partition defining a first and a second recess for the reception therein of said first and second springs respectively;

said housing defining a first and second bore, said bores being disposed adjacent to said first and second blade means respectively, said bores slidably receiving therein said manual release means;

said release means including:

a first and a second button slidably disposed within said first and second bore respectively of said housing, said buttons each having a blade engaging end and a finger engaging end, said blade engaging ends of said buttons being disposed on the opposite side of said respective blade means relative to said biasing means such that when said release means is disposed in said second disposition, said blade means are urged by said buttons towards each other against said biasing means such that said first and second blade means are released from the outlet socket; and said blade engaging ends of said buttons including;

a first and second head respectively for limiting the outward travel of said buttons within said first and second bores.

2. An electrical plug device as set forth in claim 1 wherein said first ends of said blade means are serrated such that frictional engagement between said first ends of said blade means and the outlet socket is increased when said release means is in said first disposition thereof.

3. An electrical plug device as set forth in claim 1 wherein said blade means further include:

a first and second terminal means electrically connected to said second ends respectively of said first and second blade means such that connection of said blade means to an electrical circuit is permitted;

said holder defining an aperture adjacent to said terminal means such that said electrical connection to said terminal means extends through said aperture.

4. An electrical plug device as set forth in claim 1 wherein said first blade means includes:

a first blade having a first and a second extremity;

a first offset portion disposed spaced and parallel relative to said first blade;

a first transitional portion extending from said first extremity of said first blade to said first offset portion;

said second blade means including:

a second blade holding a first a second termination;

a second offset portion disposed spaced and parallel relative to said second blade;

a second transitional portion extending from said first termination of said second blade to said second offset portion such that in use of the device, said first and second offset portions releasably engage the outlet socket when said release means is in said first disposition thereof.

5. A safety plug device for insertion within an electrical socket so that unauthorized access to the outlet socket is inhibited, said safety plug device comprising:

a housing;

first and second blade means, each blade means having a first and a second end, said first ends of said blade means extending from said housing, said blade means being of electrically insulating material such that insertion of said blade means within said outlet socket is permitted;

biasing means for biasing said blade means relative to each other such that said blade means establish an interference fit within the outlet socket so that inadvertant and unauthorized removal of said blade means from within the outlet socket is inhibited;

manual release means connected to at least one of said blade means for selectively counteracting said biasing means such that when said release means is in a first disposition thereof, said blade means are locked within the outlet socket and when said release means is in a second disposition thereof, said blade means are released from engagement within the outlet socket so that removal of the plug device from the outlet socket is permitted;

said first and second blade means including:

a plurality of first and second blades, each of said first blades being disposed spaced and parallel relative to each other, each of said second blades being disposed spaced and parallel relative to each other such that said plurality of first and second blades cooperate with an outlet socket defining multiple outlets;

said first and second blades being of flexible resilient material such that said first and second blades are resiliently inclined away from each other for locking engagement within said multiple outlet;

a first and second button slidingly cooperating with said housing, said buttons including respectively:

a pair of ears for bearing against said first blades for urging said first blades towards said second blades for releasing said blades from said multiple outlet; and a further pair of ears for bearing against said second blades for urging said second blades towards said first blades for releasing said blades from said multiple outlet.

* * * * *